United States Patent [19]

Weil

[11] 4,098,160

[45] Jul. 4, 1978

[54] ADJUSTABLE CUTTING DEVICE

[76] Inventor: Hans Herman Weil, 8 III Östra Tullgatan, Malmö, Sweden, S-21128

[21] Appl. No.: 665,121

[22] Filed: Mar. 8, 1976

[51] Int. Cl.[2] ..... B26D 5/08

[52] U.S. Cl. ..... 83/468; 83/522; 83/614; 33/DIG. 9; 33/95

[58] Field of Search ..... 83/522, 614, 468; 33/DIG. 9, 95

[56] References Cited

U.S. PATENT DOCUMENTS

| | | | |
|---|---|---|---|
| 1,183,977 | 5/1916 | Hoefle | 33/DIG. 9 |
| 3,227,016 | 1/1966 | Moeller | 83/468 |
| 3,242,780 | 3/1966 | Ried et al. | 83/614 |
| 3,527,131 | 9/1970 | Ellerin | 83/522 |

*Primary Examiner*—Donald R. Schran

*Attorney, Agent, or Firm*—Burns, Doane, Swecker & Mathis

[57] ABSTRACT

The invention comprises an adjustable device for cutting recesses in cardboard, in sheet metal and other sheet materials. The device comprises a movable angular member carrying a cutting means, which movable member can be caused to assume two positions. The movable member is guided by an adjustable lockable mechanism.

6 Claims, 14 Drawing Figures

ADJUSTABLE CUTTING DEVICE

This invention relates to an adjustable cutting device for cutting recesses of frame or window shape into cardboard, leather, foils, sheet metal or other sheet material.

When cutting, for example, passe-partouts for certain objects, for example, pictures, usually the picture is measured with a measure gauge, corner points are marked on a cardboard sheet, lines are drawn, and a recess manually is cut out of the cardboard sheet along inserted lines. This work, however, takes much time and, moreover, involves the risk of incorrect marking and, consequently, incorrect cutting. The work is especially laborious when many frames are to be cut out, particularly when a high precision is required.

The present invention has the object of producing a device, by which both the measuring and the cutting can be carried out and which substantially reduces the risk of mismeasurement.

This object is achieved by means of an adjustable cutting device, which has been given the characterizing features defined in the attached claims.

Figure 1:
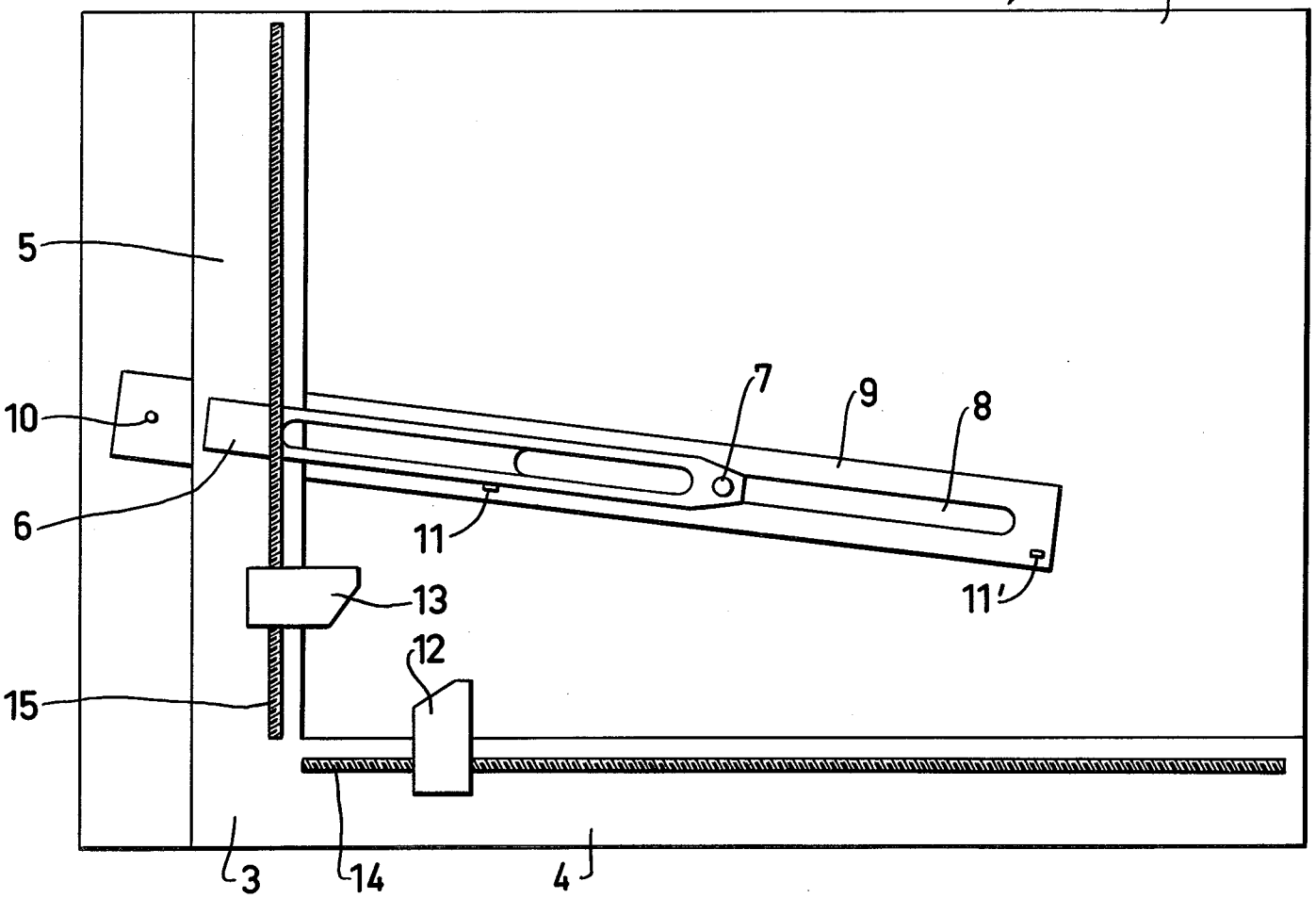
Figure 2:
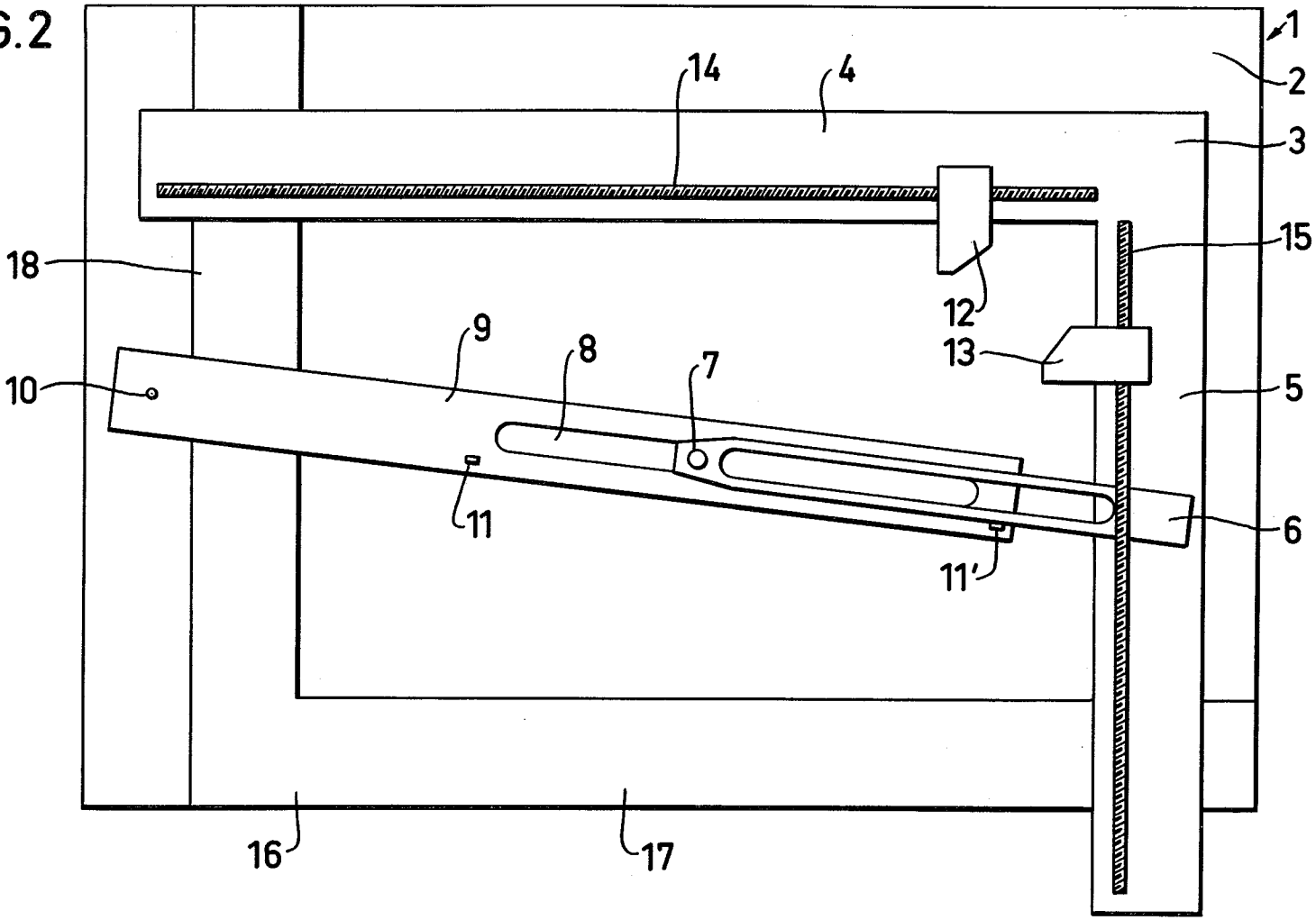
Figure 3:
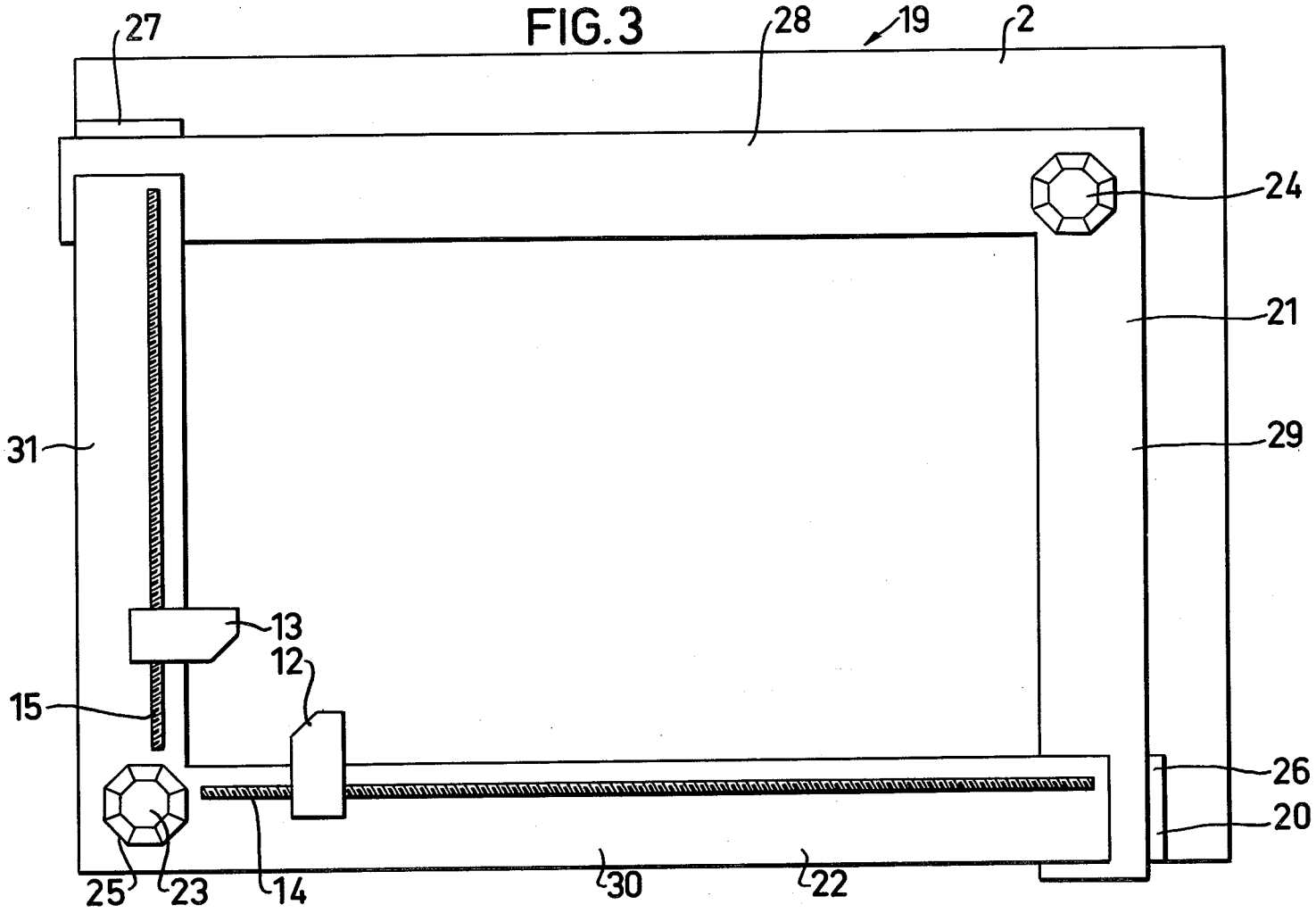
Figure 5:
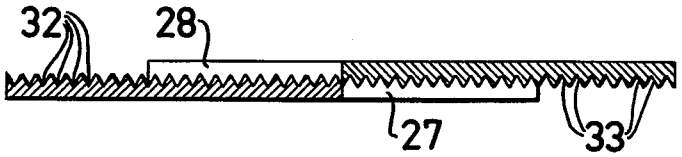
Figure 6:
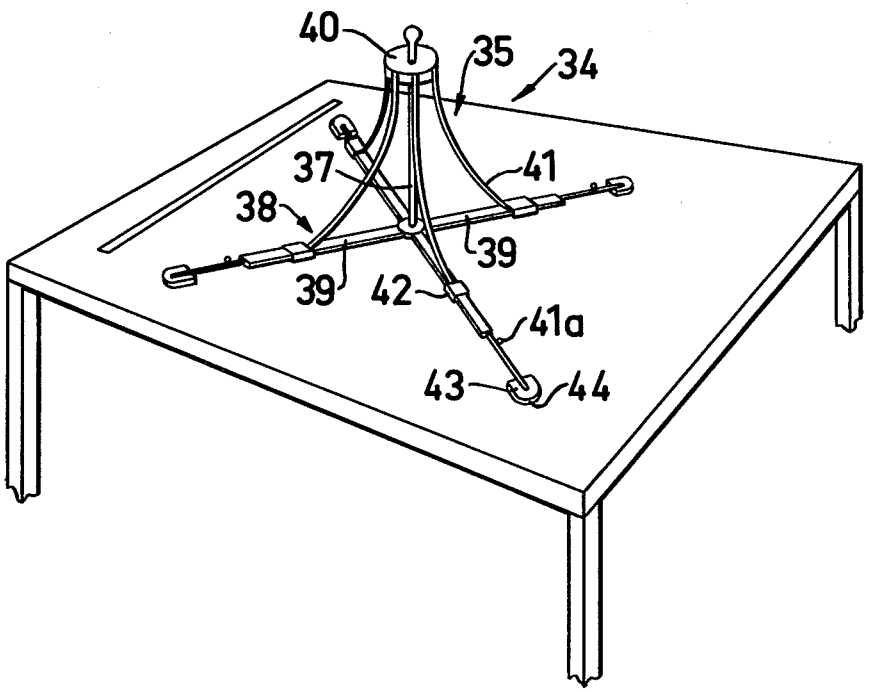
Figure 4:
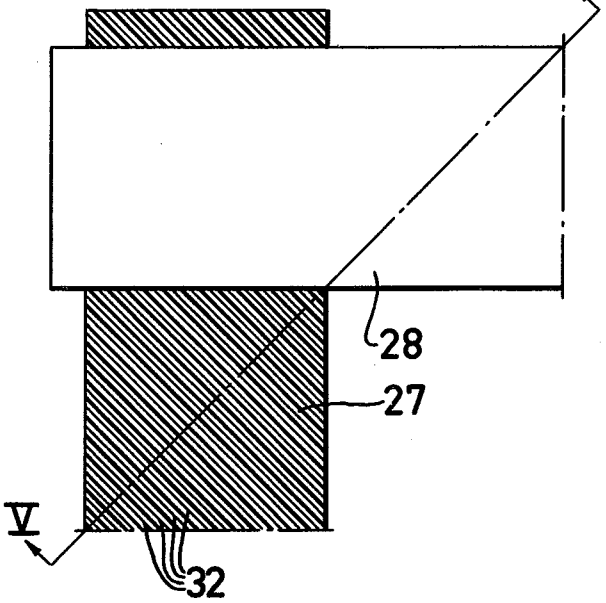
Figure 7:
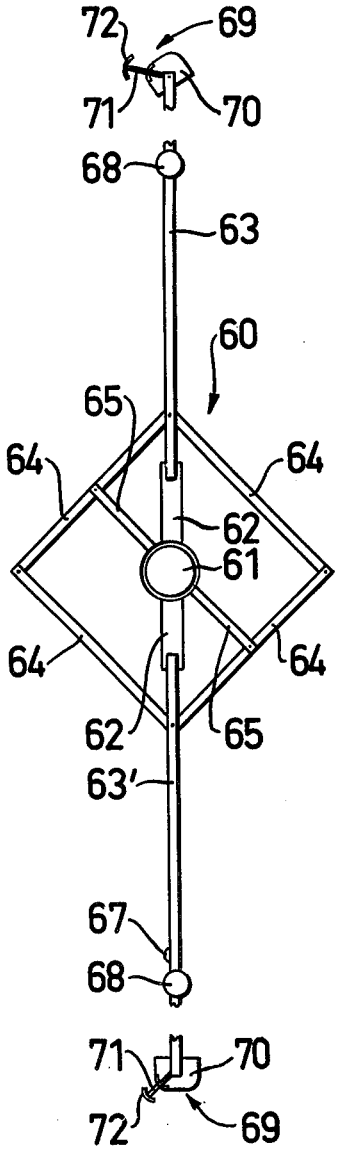
Figure 8:
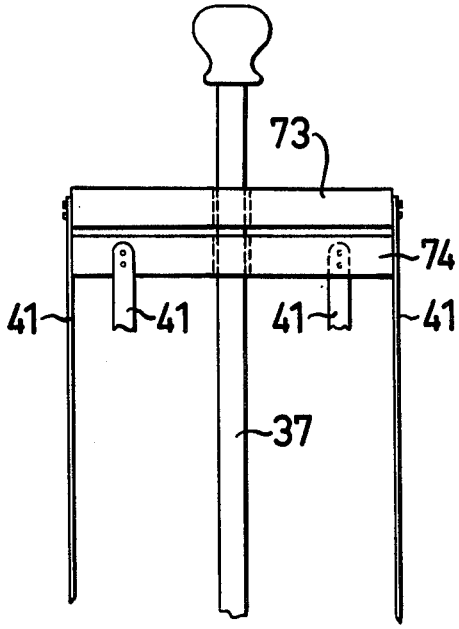
Figure 10C:
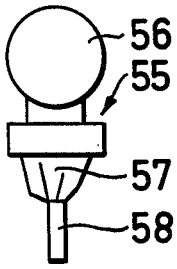
Figure 10B:
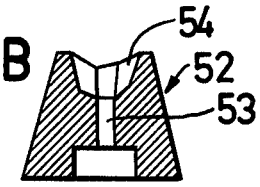
Figure 9:
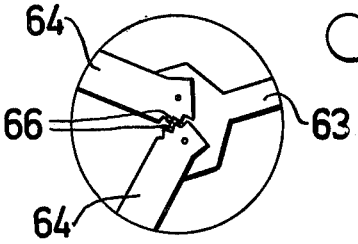
Figure 10A:
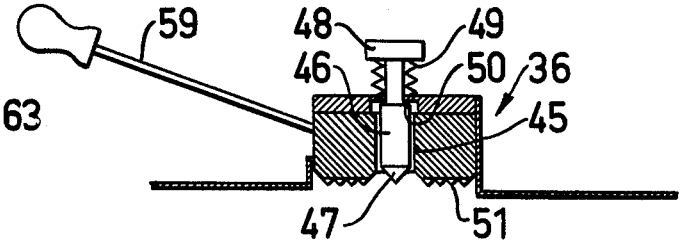
Figure 11:
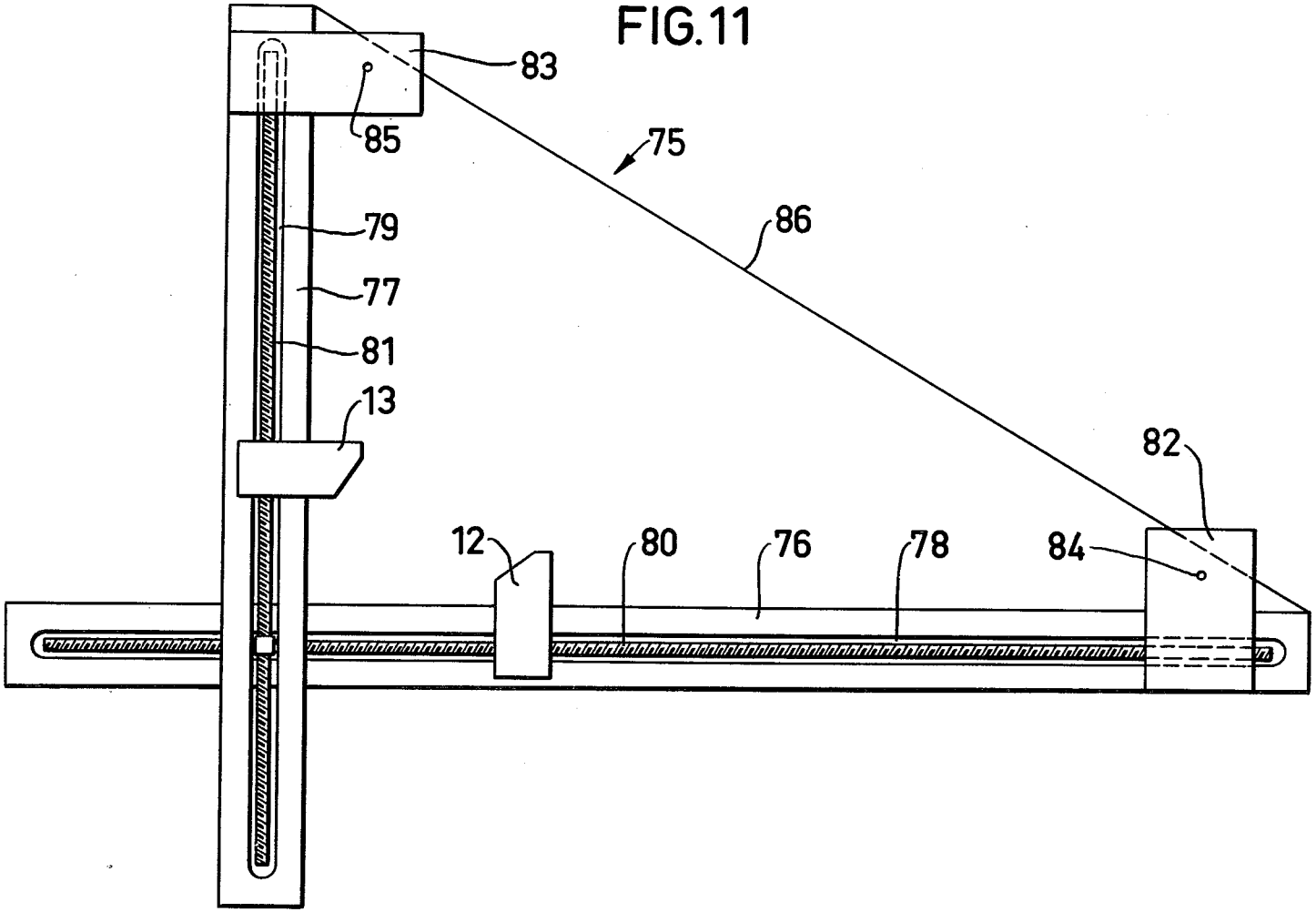
Figure 12:
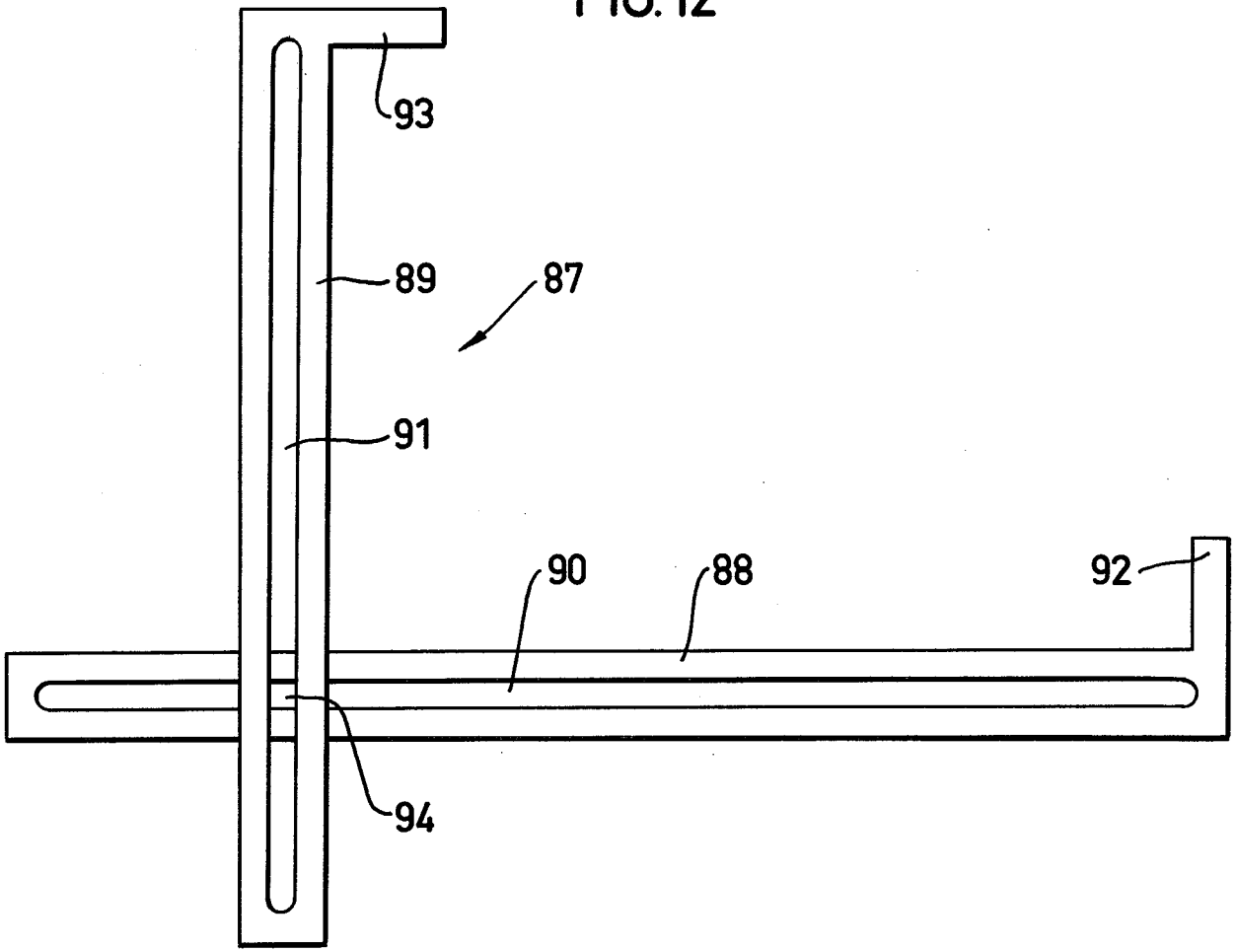

In the following some embodiments of the invention are described with reference to the accompanying drawings, in which FIGS. 1 and 2 are horizontal views of a cutting device according to the invention, FIG. 3 is a horizontal view of a second cutting device according to the invention, FIG. 4 shows a detail in FIG. 3, FIG. 5 is a section along V—V in FIG. 4, FIG. 6 is a perspective view of a measuring instrument according to the invention, FIG. 7 is a horizontal view of another embodiment of a measuring instrument according to the invention, FIG. 8 is a lateral view of an upper portion of the measuring instrument, FIG. 9 is a horizontal view of an enlarged section of a joint comprised in the measuring instrument, FIGS. 10A–10C are a lateral view and section, respectively, of a lower portion of the measuring instrument, FIG. 11 shows a further embodiment of a cutting device according to the invention, and FIG. 12 shows an embodiment of guide rulers comprised in the cutting device.

In FIGS. 1 and 2 a cutting device 1 is shown which comprises a lower structure 2, an angular ruler 3 with legs 4 and 5 arranged perpendicular to each other, a rule 6 to be coupled together with the ruler 3 and having a pin 7 positioned in a groove 8 of a guide ruler 9. The guide ruler 9 is pivotal about an axle 10 and provided with two stop members 11 and 11', respectively, which determine the two end positions of the rule 7 shown in FIGS. 1 and 2, respectively. On both legs 4 and 5 of the ruler 3, besides, knife members 12 and 13 are attached. At the embodiment according to FIGS. 1 and 2 the knife members 12 and 13 are moved by means of threaded spindles 14 and 15, the rotation motion of which is effected, for example, by an electric motor (not shown). The knife members 12 and 13, however, can be moved in another way, for example manually.

The knife members 12 and 13 shown in FIGS. 1 and 2 further comprise knife blades (not shown), which are inclined at a suitable angle to the plane of the lower structure 2 so that the cut edges of the cardboard or the like are bevelled.

As appears from FIG. 2, the cutting device 1 comprises a second angular ruler 16, which in FIG. 1, thus, is located below the first angular ruler 4. Also said second angular ruler 16 comprises two legs 17 and 18, which form a right angle with each other.

In FIG. 3 a second embodiment of a cutting device 19 is shown which comprises a lower structure 2, a first and a second angular ruler 20 and 21, respectively, of which the ruler 20 to its greater part is covered by a third angular ruler 22, which is provided with knife members 12 and 13 which, as at the embodiment according to FIGS. 1 and 2, are moved by means of threaded spindles 14 and 15.

On the first and the second angular ruler 20 and 21, respectively, cone-shaped fitting keys 23 and 24 are attached which are located in the corners 20 and 21 of the angular rulers. At the embodiment shown, the fitting keys 23 and 24 are octagonal cones, but a great number of other shapes, of course, can be imagined.

The third angular ruler 22 is provided with a hole 25 corresponding to the fitting keys 23 and 24, through which hole in FIG. 3 the fitting key 23 projects upward. When the hole 25 of the third angular ruler 22 is lowered over the fitting keys 23 and 24, the third angular ruler 22 coincides with the first and, respectively, the second angular ruler 20 and 21, respectively.

The legs 26, 27; 28, 29; and 30, 31, respectively, of the angular rulers 20, 21 and 22 form a right angle with each other.

As appears from the detail shown in FIG. 4, the angle leg 27 is provided in its upper surface with grooves 32. The angle leg 28 has corresponding grooves 33 in its lower surface, see FIG. 5. As the grooves 32 and 33 form angles of 45° with the longitudinal edges of the angle legs 27 and 28, the mutual guidance of the grooves relative to each other implies that the angle legs 27 and 28 always form a right angle with each other. The angle legs 27 and 28 can also be moved relative to each other in the longitudinal direction of the grooves 32 and 33 while maintaining the relative right angle. The aforesaid information on the angle legs 27 and 28 applies also to the angle legs 26 and 29.

In order to determine the size of the window to be cut out of the cardboard, leather, foil, sheet metal etc., further a measuring instrument is required, of which two embodiments are described in the following.

The measuring instrument 34 shown in FIG. 6 shows a main part 35 and a lower part 36 (which is shown detached from the instrument in FIG. 10A). The main part 35 of the measuring instrument has a central axle 37 and two pairs of indicators 38 attached on said axle. The indicators according to the embodiment shown comprise arms 39, which are located in pairs in the extension of each other. Each pair of arms are rotatably mounted on the central axle 37, so that one pair of arms can be adjusted in relation to the other pair of arms, or both pairs of arms can be adjusted relative to each other. On the central axle 37 a control means 40 is longitudinally movably mounted, from which control means extend four motion transmission elements in the form of flexible steel strips 41 or the like. The steel strips 41 pass through guide means 42 in or on the arms 39, so that the steel strips 41 sliding in said guide means can move relative to the arm 39. Said guide means 42 may consist of a sleeve stationary or movably mounted on each arm 37 and/or a recess (not shown) in the arm proper, so that the respective steel strip 41 is held directed outward from the arm 39 extending in the extension of the longitudinal axis of the arm.

Each steel strip 41 is provided at its outer end with an indicator element 43 stationary mounted on the steel strip 41 or mounted so as to be pivoted relative to the strip about a vertical axle (not shown). Each indicator element 43 may possibly have an arched end surface 44. The steel strips 44 may possibly be provided with handles 41a near the indicator elements 43.

The detachable lower part 36 of the measuring instrument 34 (see FIG. 9) is provided with a bore 45 intended to guide a pin 46 extending therethrough and having a point 47. The pin 46 is provided with an end plate 48 and between said plate and the lower part with a spring 49, which holds the pin 46 drawn into the lower part 36, so that an edge 50 thereon abuts the lower part, and the point 47 is located inside of the lower surface (51) of the lower part (which surface preferably is provided with jags or other projections). The pin 46 is held in this position when the lower part 36 is coupled to the measuring instrument. In order to actuate the pin 46 so as to press it down, i.e. that the point 47 is caused to reach outside the lower surface 51, a coupling member 52 can be coupled to the lower part 36. The coupling member 52 includes a through bore 53 and a recess 55 with irregular guide surfaces. The pin 46 can be pressed down thereby that the coupling member 52 is coupled to the lower part 36, and a control member 55 with a handle 56, a coupling portion 57 and a projecting pin 58 is coupled to the coupling member 52, whereby the pin 58 presses the pin 46 downward. The coupling portion 57 is shaped so as to fit into the recess 54 only when the control member is held set in a definite way in relation to the coupling member.

The lower part 36 can comprise or be provided with a handle 59 for rotating the lower part. Furthermore, a scale (not shown) can be provided in the vicinity of the lower part 36 without participating in the rotation thereof, so that the number of degrees can be indicated through which the lower part 36 has been rotated or is to be rotated.

In FIG. 7 a measuring instrument 60 of a somewhat different type is shown in a schematic manner. The central element of the instrument is designated by 61, and from said element extend at least two guide sleeves 62. The indicators comprise arms 63, which in a telescopic manner engage with the guide sleeves 62. The arms 63 are interconnected via motion transmission stay members 64, which are hingedly connected with each other and with the arms. Two stay members 65 rigidly connected with the central element 61 are hingedly connected to the transmission stay members 64 and thereby ensure constantly maintained central position of the element 61. In FIG. 9 an alternative way is shown of effecting the arms 63 and 63' always to be located in the extension of each other. According to this embodiment, each stay member 64 comprises a tooth-shaped end portion 66 intended to mesh with a corresponding tooth-shaped end portion 66 on an adjacent stay member 64. Said stay members 64 are with their end portions 66 hingedly connected to the end of the arm 63 and 63', respectively, the extension of which thereby always coincides with the bisectrix of the angle between the stay members 64.

Each arm 63 in a pair of arms (of which only one is shown in FIG. 7) shows either a protuberance 67 projecting in lateral direction or a recess (not shown) corresponding thereto, so that the pairs of arms can be set to lie adjacent each other. In order to permit pivotal motion of the pairs of arms relative to each other, said pairs can be arranged on different rotatably mounted members (not shown) on the central axle 61. Each arm 63 further comprises a handle 68, and its indicator elements 69 consist of a pivotally mounted end piece 70, a pivotally mounted holder 71 of variable length and an indicator member 72 with a rounded outer surface on said holder 71.

FIG. 8 illustrates that the control means 40 of the measuring instrument 34 can consist of two parts 73, 74, and that two of the four steel strips 41 are attached on one of these parts. As each part 73, 74 is mounted so as to be movable relative to the other part on the central axle 37, the position of one pair of indicator elements 43 can be changed independently of the position or movements of the other pair of indicator elements 43.

The measurements and cutting out of a window, for example in a passe-partout, take place as follows.

The object in question, about which the passe-partout is to be attached, is measured by means of the measuring instrument, and an indicator element is set above each corner point of the object. Hereby the relative position of the four corner points of the object and its central point are obtained.

When, for example, the cutting device 1 shown in FIGS. 1 and 2 is used, the set measuring instrument 34, 60 is placed on a cardboard sheet, from which the passe-partout is to be cut out and which is attached on the lower structure 2. The measuring instrument 34, 60 is so adjusted that one of the indicator elements 43, 69 is located in the right angle of the angular ruler 3 of the two adjacent indicator elements 43, 69 along the angle legs 4 and 5, respectively, of the angular ruler 3. Thereafter the central point of the object is marked. The pin 7 associated with the rule 6 is thereafter placed straight above this central point. The rule 6 is coupled together with the angle leg 5, for example in an electromagnetic manner, whereafter the rule 6 with the angular ruler 3 is rotated 180° about the pin 7, i.e. until the rule 6 abuts the stop member 11', see FIG. 2. The two angular rulers 3 and 16 thereby define the wanted window in the passe-partout. Thereafter the coupling between the rule 6 and angular ruler 3 is released, and the guide ruler 9 is pivoted to the side about the axle 10. The two knife members 12 and 13 then cut out two of the sides in the window whereafter the ruler 3 is moved to the position shown in FIG. 1, and the cutting out of the two remaining sides takes place.

At the cutting device according to FIG. 3 the two angular rulers 20 and 21 can be moved relative to each other by means of the measuring instrument 34, 60 so that the desired window size is obtained. It can also be imagined to remove the angular rulers 20 and 21 from the lower structure 2 and to measure directly with these rulers on the object. When the two angular rulers 32 and 33 engage with each other (see FIG. 5), this mutual position is fixed by a suitable locking clip or the like. The angular ruler 22 is lowered over the fitting key 23, and two of the sides of the window are cut out by means of the knife members 12 and 13. The angular ruler 22 is thereafter moved to the fitting key 24, and the procedure is repeated.

In FIG. 11 an embodiment of cutting device 75 is shown, at which like at the device according to FIG. 3 a measuring instrument is not necessarily required. The device according to FIG. 11 comprises two guide rulers 76 and 77, which are provided with longitudinal oblong slots 78 and 79, respectively, in each of which a spindle 80 and 81 are provided, along which knife members 12 and 13 are movable. The spindles 80 and 81 can be attached stationary or detachably in the slots 78 and 79. At the two ends of the guide rulers 76 and 77 located in two diagonally opposed corners of the object, fixing members 82 and 83 movable along the guide rulers 76 and 77 are provided which have holes 84 and 85 for passing an awl or another sharp-pointed object (not shown) therethrough. The cutting out of a passe-partout window with the device according to FIG. 11 takes place as follows. The two guide rulers 76 and 77 are attached on the object in question for which a passe-partout is to be cut out. In the case when the spindles 80 and 81 with knife members 12 and 13 are stationary mounted in the slots 78 and 79, the side facing toward the observer is turned toward the object, because otherwise the knife members 12 and 13, which are directed inclined into the paper in FIG. 11 to cut bevelled edges, would damage the object. When the sides of the object have been measured by the guide rulers 76 and 77, and these rulers are fixed relative to each other, the fixing members 82 and 83 are so adjusted by means of the stretchable cord 86 that the holes 84 and 85 are located on the diagonal of the object. The guide rulers 76 and 77 with knife members 12 and 13 are then moved to the cardboard sheet or the like in which the cutting out is to take place. An awl or the like is pierced through the holes 84 and 85 so that markings along one diagonal of the cut-out are formed. Thereafter two of the window edges are cut with the knife members 12 and 13, and then the guide rulers are pivoted through 180° about the centre of the window, and the holes 84 and 85 are adjusted over the diagonal markings and the two remaining sides of the window are cut out.

In FIG. 12 a further embodiment of an angular ruler 87 is shown which consists of two guide rulers 88 and 89 arranged perpendicularly to each other. These guide rulers are provided with longitudinal slots 90 and 91 and at their respective ends with projections 92 and 93. The angular ruler 87 is used for measuring the sides of the object, for which a passe-partout is to be cut out, and the lengths of these sides are adjusted by moving the guide rulers 88 and 89 relative to each other in their point of intersection. The guide rulers 88 and 89 are then fixed relative to each other in a suitable way. In the square hole 94 formed in the point of intersection of the guide rulers a fitting key (not shown) is attached. In order to form the size of the window to be cut out of the cardboard sheet or the like, the angular ruler 87 shown in FIG. 12 is coupled together at the ends of the guide rulers 88 and 89 with another identical angular ruler having an identical setting of the guide rulers relative to each other. Thereafter an angular ruler with cutting device and fitting holes is attached on the angular ruler 87 and its opposite identical angular ruler in the same way as at the device according to FIG. 3, whereafter the window is cut out.

The aforesaid knife members 12 and 13 may also be designed so as to render possible simultaneous cutting and stamping of the edges of the passe-partout window.

What I claim is:

1. A device for plotting and cutting out a window-shaped recess in sheet material such as cardboard, leather, foil and sheet metal, which comprises a pair of angle shaped ruler means having shanks in overlapping surface contact so as to frame four sides of a recess to be cut out;

guide means in at least two shanks of such ruler means and capable of maintaining an invariable angular relationship of said pair of ruler means when the shanks of one of said pair of ruler means are displaced relative to the shanks of the other of said pair of ruler means;

at least two cutter means capable of cutting out at least two edges of recess at the same time;

clamping means and key means at the intersections of the shanks of said pair of ruler means; and a third ruler means having thereon socket means mating with the key means of one of said pair of angle shaped ruler means for locking the shanks of said one of said pair of ruler means and said third ruler means in a selected angular position.

2. A device according to claim 1, wherein said third ruler means comprises an angle-shaped member provided with cutter means and actuating means therefor.

3. A device according to claim 1, wherein said guide means comprise mating ridges and grooves for interlocking engagement so as to permit said ruler shanks relative sliding movement only on being held in surface contact with each other.

4. A device as claimed in claim 2, characterized in that said cutter means are operable manually along said angle-shaped member.

5. A device as claimed in claim 2, wherein threaded spindle means are provided for power-operating said cutter means.

6. A device as claimed in claim 1, wherein said cutter means are designed for simultaneous cutting and stamping.

* * * * *